US008179058B1

(12) United States Patent
Campbell et al.

(10) Patent No.: US 8,179,058 B1
(45) Date of Patent: May 15, 2012

(54) DETERMINE A SETTING OF A TRIAC DIMMER THROUGH INDUCED RELAXATION OSCILLATION

(75) Inventors: Gregory Campbell, Walpole, MA (US); Jerome Issa, Norwood, MA (US); Joseph Michael DiBartolo, South Boston, MA (US)

(73) Assignee: Lumenpulse Lighting, Inc. (CA)

( * ) Notice: Subject to any disclaimer, the term of this patent is extended or adjusted under 35 U.S.C. 154(b) by 0 days.

(21) Appl. No.: 13/346,200

(22) Filed: Jan. 9, 2012

Related U.S. Application Data

(60) Provisional application No. 61/485,910, filed on May 13, 2011.

(51) Int. Cl.
*H05B 37/02* (2006.01)
*G05F 1/00* (2006.01)

(52) U.S. Cl. ..... 315/291; 315/307

(58) Field of Classification Search ..... 315/291, 315/307, 224, 209 R, DIG. 4, DIG. 2, DIG. 5; 323/265, 274, 284, 282; 324/522, 523, 525, 324/750.01, 72, 74, 76.11
See application file for complete search history.

(56) References Cited

U.S. PATENT DOCUMENTS

| | | | | |
|---|---|---|---|---|
| 7,015,656 | B2 * | 3/2006 | Wang | 315/291 |
| 7,791,326 | B2 * | 9/2010 | Dahlman et al. | 323/284 |
| 8,040,071 | B2 * | 10/2011 | Lin et al. | 315/224 |
| 2005/0179405 | A1 | 8/2005 | Wang | |
| 2009/0167203 | A1 | 7/2009 | Dahlman et al. | |
| 2009/0315477 | A1 | 12/2009 | Kinsella | |
| 2010/0090618 | A1 | 4/2010 | Veltman | |
| 2011/0037399 | A1 | 2/2011 | Hung et al. | |
| 2011/0127925 | A1 | 6/2011 | Huang et al. | |
| 2011/0140620 | A1 | 6/2011 | Lin et al. | |
| 2011/0140628 | A1 | 6/2011 | Lei et al. | |
| 2011/0163684 | A1 | 7/2011 | Li et al. | |

* cited by examiner

*Primary Examiner* — Douglas W Owens
*Assistant Examiner* — Minh D A
(74) *Attorney, Agent, or Firm* — Pierce Atwood, LLP; Joseph M. Maraia

(57) ABSTRACT

A system for controlling power delivered to a lighting system for controlling illumination. The system includes a TRIAC with an input capacitor connected in parallel to a phase delay circuit including a series combination of a potentiometer and a capacitor. A ramp voltage output from the timing circuit is connected through a DIAC to a gate input of the TRIAC. The TRIAC is connected between a DC voltage source and an electrical load. In response to the DC source, the input power storage capacitor, the phase delay timing circuit and the input terminal of the TRIAC have a direct current output voltage higher than a DIAC breakover voltage, used to drive a gate input of the TRIAC. The TRIAC operates in relaxation oscillation mode such that a frequency of oscillation of the TRIAC circuit, as controlled by the timing resistor, can be used to control power to the electrical load.

19 Claims, 5 Drawing Sheets

DETERMINE A SETTING OF A TRIAC DIMMER THROUGH INDUCED RELAXATION OSCILLATION

RELATED APPLICATIONS

This application claims the benefit of U.S. Provisional Application No. 61/485,910, filed May 13, 2011. The entire teachings of the above application are incorporated herein by reference.

BACKGROUND

1. Technical Field

This application relates generally to the field of lighting. More particularly, this application relates to the technology of controlling electrical loads, such as the intensity (i.e., dimming) of lighting sources.

2. Background Information

Presently, there are a variety of lighting sources in widespread commercial use. Some popular examples include incandescent, fluorescent, and solid state (e.g., light emitting diode (LED)) lighting sources. Even within certain lighting categories, there can be further distinctions, such as incandescent lighting operating at AC line-voltage levels (e.g., 120V, 60 Hz), or at DC low voltage (e.g., 6, 12, or 24 volts). Lighting sources operating at DC low voltages can be further distinguished into those using magnetic transformers and those using electronic (e.g., solid state) transformers. LED lighting sources typically require a matched LED driver, or power supply, providing the appropriate driving current and voltage levels dependent upon the nature of the LED lighting source.

In many lighting applications it is desirable to provide some measure of control to allow for variability of one or more attributes of the lighting source beyond simply "on" and "off" For example, a dimmer control can be provided to otherwise control the power delivered to the lighting source to achieve desired illumination intensity. Each type of lighting source (load types) has individual characteristics that generally require special types of dimmers. It is important to use a dimmer that is designed, tested, and UL listed for the specific lighting source/load type.

Dimmer controls can be user accessible, for example, as in wall switch styles providing a user adjustable control, such as a rotary knob, a sliding switch and electronically controllable switches (e.g., capacitively coupled). A user adjustment of the control is automatically converted by the dimmer into a corresponding power adjustment, for example, allowing a continuous adjustment of the resulting illumination from a maximum power (e.g., 100% or full on) to a minimum power (e.g., below 10% or off). As a consequence of fundamental differences between the various lighting sources, a dimmer for one might not work with another. Thus, a dimmer control suitable for incandescent lighting may not be suitable for fluorescent or solid state lighting sources.

One such class of dimmer controls is referred to as TRIAC (triode for alternating current) dimmer controls. Basically, TRIAC based light dimmer circuits "chop up" the sine wave voltage, that is, removes portions of the sine wave waveform so that the average voltage and thus the average power passed to lighting system is reduced, thereby reducing the emitted power of the lighting system. Such devices are typically used for incandescent lighting applications. At its full brightness setting, the TRIAC dimmer control allows most, if not all, of the AC power waveform to pass through it, to power the light. As the dimmer control is adjusted to a dimmer setting, a greater proportion of each AC power cycle is chopped proportional to the position of an internal potentiometer. A dimmer setting results in a lower average (e.g., RMS) power over the period, resulting in corresponding reduction of illumination output.

Unfortunately, such "chopping" of the voltage and current waveforms, which introduces rapidly changing transients and waveform edges into the "chopped" waveform, results in the generation of undesired high frequency components into the waveform, resulting in radio frequency noise and interference. In lighting systems, rapid transients and waveform edges in the power waveforms further effect elements of the system, such as filaments of a bulb, causing such elements of the system to vibrate and causing an undesired buzz to emanate from the bulb or the lighting system. Moreover, such "chopping" is not well suited for all lighting sources.

TRIAC dimmer controls are generally not well suited for LED lighting sources. Such solid-state lighting applications generally include a power supply converting facility AC power to power suitable for the solid state lighting. In particular, for LED lighting the direction of current as well as its amplitude are controlled by such a power supply to provide desired illumination. As such, digital lighting applications are typically isolated from the AC mains by the presence of such a driving power supply. Accordingly, there is no assurance that providing a TRIAC chopped AC signal to a driving power supply associated with solid state lighting will result in the intended illumination setting, or dimming. In fact, there is no assurance that the solid state lighting will even operate as intended when powered by such a chopped AC waveform.

SUMMARY

It would be desirable to overcome the above mentioned shortcomings and drawbacks associated with the prior art.

Described herein are techniques for controlling power delivered to a lighting system in order to control the intensity of illumination of the lighting system. In particular, techniques are described herein for enabling various lighting systems to use TRIAC dimmer controls as a source of input for dimming solid state or traditional sources, without the typical negative effects often associated with the use of a TRIAC dimmer provided in combination with (e.g., series) such lighting arrangements. Low-power, low-voltage devices and processes are described for sampling a TRIAC dimmer control's position, such that the TRIAC dimmer can be utilized in systems with high voltage power signals, and without regard to the controlled lighting technology.

In one aspect, at least one embodiment described herein provides a process for dimming a light. The process includes applying a test voltage to a dimmer device (e.g., a TRIAC dimmer), the dimmer device having a user-adjustable control input settable between low and high dimmer settings. A relaxation oscillation is induced within the dimmer device in response to the applied test voltage. A measure of the relaxation oscillation is determined by at least one of a frequency and a period of the dimmer's relaxation oscillation response. The relaxation oscillation is indicative of a setting of the user-adjustable control input. The measure of the relaxation oscillation is used to dim a light source responsive to the determined dimmer device setting.

In another aspect, at least one embodiment described herein provides a system for dimming a light. The system includes a power supply in electrical communication with a dimmer device having a user-adjustable control input settable between low and high dimmer settings. The power supply is configured to provide an electrical input not less than a threshold value sufficient to induce a relaxation oscillation within the dimmer device. The relaxation oscillation is indicative of a setting of the user-adjustable control input. The system also includes a frequency detector in electrical communication with the dimmer device. The frequency detector is configured to detect at least one of a frequency and a period of the relaxation oscillation.

In yet another aspect, at least one embodiment described herein provides a system for detecting a setting of a line voltage dimmable controller. The system includes means for applying a test voltage to a TRIAC dimmer device having a user-adjustable control input settable between low and high dimmer settings. The system also includes means for initiating within the TRIAC dimmer, a relaxation oscillation responsive to the applied test voltage, and means for determining at least one of a frequency and a period of the relaxation oscillation initiated within the TRIAC dimmer. The relaxation oscillation is indicative of a setting of the user-adjustable control input.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DESCRIPTION OF THE PREFERRED EMBODIMENTS

In the following detailed description of the preferred embodiments, reference is made to accompanying drawings, which form a part thereof, and within which are shown by way of illustration, specific embodiments, by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the case of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in that how the several forms of the present invention may be embodied in practice. Further, like reference numbers and designations in the various drawings indicate like elements.

Figure 1:
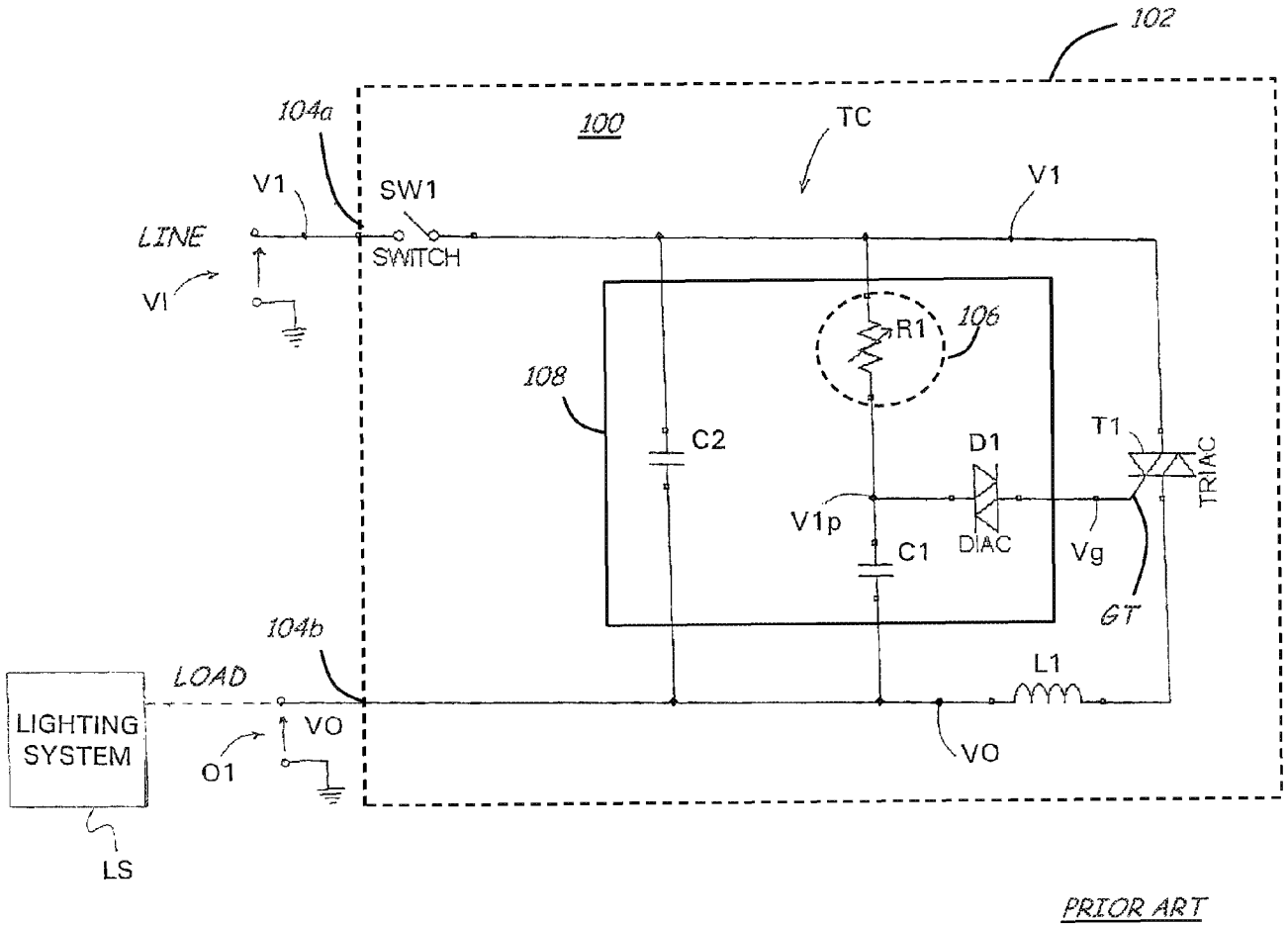
PRIOR ART FIG. 1
FIG. 1 is an electronic circuit schematic of an example of a conventional TRIAC dimmer control.

FIG. 1 depicts an electronic circuit schematic of an example of a conventional TRIAC dimmer control 100 often used in traditional lighting applications. The dimmer control 100 includes a housing 102, with at least two externally accessible ports or terminals 104*a*, 104*b* (generally 104). The housing 102 can conform to that of a typical single or multi-gang electrical switch, suitable for installation within a standard electrical box. A first externally accessible terminal 104*a* is intended under normal operation for connecting to a power line, such as a 120 Volt, 60 Hz AC power line (e.g., LINE). A second externally accessible terminal 104*b* is intended under normal operation for connecting to a controlled device, such as one or more incandescent lamps (e.g., LOAD). The TRIAC dimmer control 100 also includes at least one user adjustable control 106, such as a knob, a dial, a slideable switch, or the like. In an intended mode of operation, the typical TRIAC dimmer control 100 receives facility AC power input by way of the LINE terminal 104*a*, chops or otherwise adjusts the AC power waveform proportionally in response to the user adjustable control 106. The TRIAC dimmer control 100 also provides the chopped AC waveform to a load (e.g., lighting source) to vary power delivered to the load proportionally to the user adjustable control 106.

The dimmer control 100 includes a TRIAC voltage control circuit 108 that includes a phase delay timing circuit, including a series combination of a timing resistor R1 and a timing capacitor C1 generating a ramp timing voltage output with a DIAC D1 connected from the ramp timing voltage and to a gate input GT of the TRIAC T1. In at least some variants, the conventional TRIAC dimmer control also includes an input power storage capacitor C2 connected in parallel with the phase delay timing circuit, as shown. The TRIAC T1 is otherwise connected in series between the LINE terminal 104*a* and the LOAD terminal 104*b*. In at least some embodiments, the dimmer control 100 includes a switch SW1 to selectively interrupt a flow of current between the LINE and LOAD terminals 104*a*, 104*b*. For example, a single-pole-single-throw switch SW1 is series coupled between the LINE terminal 104*a* and an adjacent terminal of the TRIAC T1, as illustrated. The switch can be used by an operator to selectively interrupt or otherwise apply electrical power to a load (e.g., lighting system LS), while preserving a user adjusted setting of the user adjustable control 106.

During normal operation, an AC input waveform V1, such as a 60 Hz alternating voltage, is introduced to the TRIAC circuit TC via an input VI and fed through switch SW1 to a remainder of the TRIAC circuit TC. The low-pass filter combination of a potentiometer R1 and a capacitor C1 phase delays the LINE terminal 104*a*, resulting in a phase delayed waveform V1*p* that is provided to a DIAC (diode for alternating current) D1. As is well known in the art, the DIAC D1 conducts current when the voltage across the DIAC D1 exceeds or is otherwise greater than the breakover voltage of the DIAC D1. Whenever the phase delayed waveform V1*p* exceeds the DIAC D1 breakover threshold, a resulting gate signal Vg is conducted through DIAC D1 to a control input (gate) GT of the TRIAC T1. As shown, the TRIAC T1 is connected between the non-phase delayed input waveform V1, that is, at the input to the series circuit comprising the potentiometer R1 and the capacitor C1 and an output terminal through inductor L1, to provide an output waveform VO at an output O1 (i.e., LOAD terminal 104*b*).

As is well known, whenever the gate trigger voltage to the TRIAC T1 is exceeded, the TRIAC T1 conducts current in either direction through the TRIAC circuit TC. The phase delayed gate control waveform Vg, provided to the control gate GT of the TRIAC T1, thereby controls the TRIAC T1 so that the TRIAC T1 enters the conducting state whenever gate signal Vg, which is essentially phase delayed waveform V1*p*, exceeds the gate trigger voltage for the TRIAC T1. When TRIAC T1 is in the conducting state, the voltage drop across the TRIAC T1 drops to a TRIAC characteristic forward voltage at an equilibrium current, and the circuit path through TRIAC T1 discharges the capacitor C2 (when present) directly and discharges the capacitor C1 through potentiometer R1, with most of the current flow coming from the capacitor C2. The inductor L1 provides a transient resistance to the flow of the current through the TRIAC T1, but the phase delayed waveform V1*p*, and thus gate control voltage Vg, eventually drop to a level lower than the gate trigger voltage of the TRIAC T1, at which point the TRIAC T1 enters a non-conducting state. The output waveform VO thereby assumes the form of "chopped" segments of the input waveform V1, with the width of the "chopped" segments being determined by the discharge time of the potentiometer R1 and the capacitor C1, thereby controlling the average power and the voltage delivered to the output O1, available to the lighting system LS to provide a desired intensity of illumination.

Figure 2:
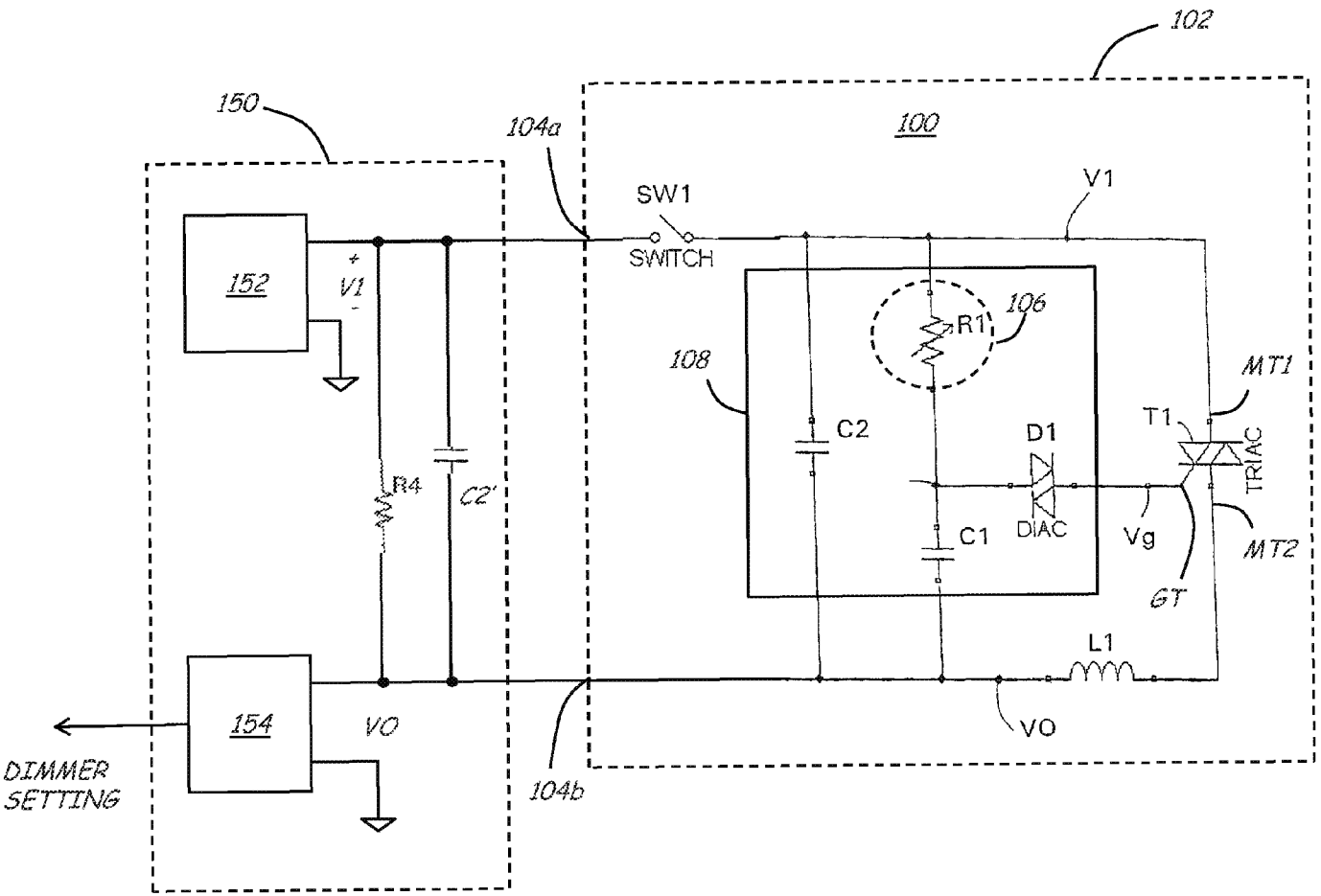
FIG. 2 is a schematic diagram of system for determining a setting of a dimmer control.

Turning now to FIG. 2, instead of providing an AC input voltage V1 to the TRIAC dimmer control 100, a dimmer adapter 150 drives the TRIAC dimmer control 100 with a DC input voltage V1, chosen to be above the breakover voltage of the DIAC D1. In particular, the DC input voltage V1 can be applied to at least one of the externally accessible terminals 104*a*, 104*b* of the dimmer control 100. In response to an applied DC voltage of a sufficient magnitude, the TRIAC dimmer control 100 enters a condition referred to as "relaxation oscillation."

The example adapter 150 includes a DC power supply 152, a detector 154 and a resistive network, shown as resistor R4. A first terminal of the DC power supply 152 is connected to the externally accessible LINE terminal 104*a* of the TRIAC dimmer control 100, whereas, as second terminal of the DC power supply 152 is connected to an electrical ground or suitable signal return. The LINE terminal 104*a* is also connected to the externally accessible LOAD terminal 104*b* through the resistor R4. In at least some embodiments, the adapter 150 includes a power storage capacitor C2' connected in parallel with resistor R4. The power storage capacitor C2' can serve the purposes of capacitor C2 described above, when not present within a conventional TRIAC dimmer. When present, capacitors C2 and C2' coupled in parallel, provide a combined charge storage capacity. In at least some examples, the value of the storage capacitor C2' is in the tens or hundreds of microfarads.

An input to the detector 154 is also coupled to the LOAD terminal 104*b* of the TRIAC dimmer control 100. In operation, the detector 154 provides an output, as shown, that is indicative of a setting of the user adjustable setting 106 (i.e., potentiometer R1). The output can be any suitable output able to convey an indication of the dimmer setting. Such outputs can include a voltage and/or current value. The value can be analog in nature, or digitized or otherwise quantized with a suitable resolution. In at least some embodiments, the output can be in the form of a digital word. Such an output conveying an indication of the dimmer setting can be used to control the intensity of illumination of a solid state or traditional lighting system, without the typical negative effects often associated with the use of a TRIAC dimmer. Thus, by using such techniques, a TRIAC dimmer can be utilized in systems with high voltage power signals, and without regard to the controlled lighting technology.

Referring first to the TRIAC dimmer control 100, and considering operation when the switch SW1 is closed, the DC voltage provided at the input terminals 104*a*, 104*b* together with the resistive load R4 present between the load terminal 104*b* and an electrical ground reference (GRN), induces an operational mode of the TRIAC dimmer control 100, generally known as "relaxation oscillation." During this mode of operation, a non-ideal source resistance (not shown) at the input terminal 104*a* causes a transient ramp of the input voltage V1 which is then phase-delayed by the combination of that resistance and the capacitor C2 and, at the DIAC D1, by the combination of the potentiometer R1 and the capacitor C1, since current flowing to charge the capacitors C1 and C2 causes a voltage to be developed across any series resistance until fully charged and the current is no longer flowing. However, once the voltage across capacitor C1 has risen above the DIAC D1 breakover voltage, the current is allowed to flow into the TRIAC gate input GT, which in turn, results in conduction through terminals MT1 and MT2 of the TRIAC T1. In such a conducting state, the voltage dropped across the TRIAC T1 resorts to its relatively low characteristic forward voltage at an equilibrium current. For a brief transient period, the inductor L1 resists a change in the current flowing through the TRIAC T1 by increasing the voltage across the inductor L1, but eventually the current is allowed to flow to the output VO and the circuitry associated with the output VO. In this regard, a load connected between the output VO and the ground (GRN) should present a high enough resistance so as not to allow a minimum holding current to flow through the TRIAC T1 at a voltage of V1 minus the forward voltage of the TRIAC T1. Thus, the minimum holding current is not present to hold TRIAC T1 in the conducting state.

Again, while the voltage across the TRIAC T1 is dropping from the voltage of V1 to the TRIAC T1 forward voltage, most of the current conducted through the TRIAC circuit TC comes from the capacitor C2. Since the capacitor C2 is arranged in parallel with the potentiometer-capacitor R1, C1 low pass filter, the gate voltage Vg drops accordingly. As the voltage across the TRIAC T1 approaches its equilibrium forward voltage, the current flowing through TRIAC T1 eventually drops below the holding current for the TRIAC T1 and the current conduction through TRIAC T1 is discontinued. Thus, a return path allowing the current to flow from one side of the capacitor C2 to the other is cut off due to the TRIAC T1 entering the non-conducting state. With the DC voltage still being supplied at the terminal 104*a*, the capacitor C2 begins to charge back to the voltage of V1 to thereby initiate another discharge cycle through the TRIAC T1. The process referred to relaxation oscillation mode, repeats indefinitely, until the DC power is removed (e.g., the switch SW1 is opened).

In summary, therefore, the capacitor C2 charges from the DC voltage V1 present at the input VI until the TRIAC T1 is triggered, whereupon the capacitor C2 is effectively short circuited by the low forward voltage of the TRIAC T1 until the capacitors C2 and C1 are sufficiently discharged to a point at which the TRIAC T1 returns back to a non-conducting state, whereupon the cycle begins again. The resulting frequency of charging and discharging of the capacitors C2 and C1 is affected by a phase delay of the gate triggering circuit. Such a phase delay can be determined by a time constant of the capacitor C1 and the potentiometer R1. With the capacitor C1 having a fixed value, this delay can be controlled by the resistance value of the potentiometer R1. The higher the resistance of the potentiometer R1, the longer it takes to charge the capacitor C1 and the longer the delay in eventual firing the TRIAC T1, since the DIAC D1 breakover voltage is not reached as quickly. Therefore, the frequency (and conversely the period) of oscillation and thus the time average output power delivered by the TRIAC circuit TC is directly controlled by the resistance of potentiometer R1. In general, any references herein to capacitor C2 of the TRIAC can be replaced with capacitor C2' of the adapter, or the combination of capacitors C2 and C2', depending on the particular configurations of the adapter and the TRIAC control.

Figure 3:
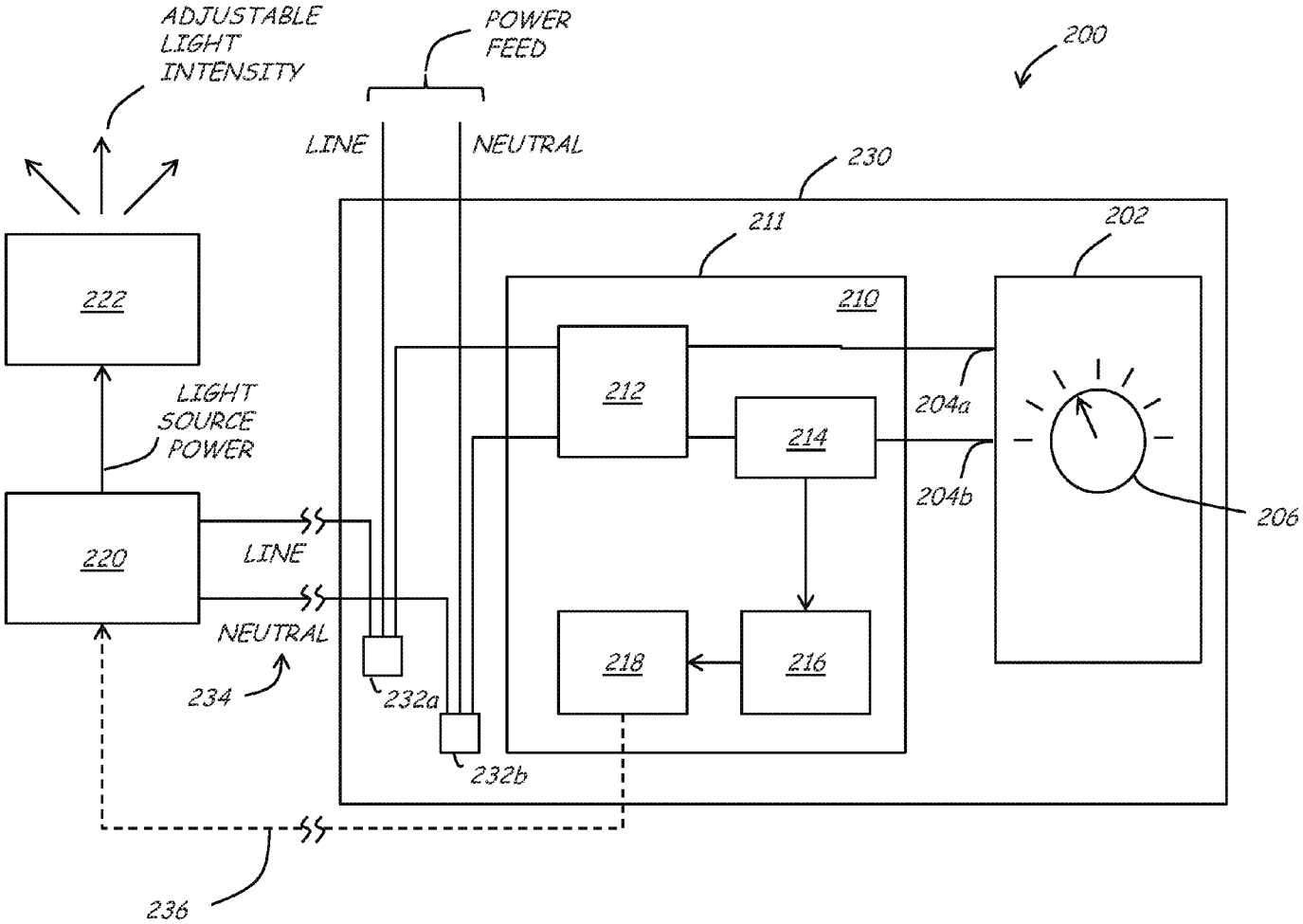
FIG. 3 is a functional block diagram of system for determining a setting of a dimmer control and dimming a light source responsive to the determined setting.

A functional block diagram of a system 200 for determining a setting of a dimmer control and dimming a light source responsive to the determined setting is shown in FIG. 3. A TRIAC dimmer control 202, such as described above, includes at least two externally accessible terminals: LINE 204*a* and LOAD 204*b*, and a user adjustable control 206. The system 200 also includes a TRIAC dimmer adapter 210 coupled between the TRIAC dimmer control 202 and an adjustable power supply 220, for example, adapted to drive a solid-state (i.e., LED) lighting source 222. In the illustrative example, the TRIAC dimmer adapter 210 and the adjustable power supply 220 receive facility AC power (i.e., LINE and NEUTRAL), whereas the TRIAC dimmer control 202 does not.

In some embodiments, the TRIAC dimmer adapter 210 receives AC power and converts the AC power to a DC test voltage. The TRIAC dimmer control 202 is not connected directly to facility AC power as would otherwise be done under normal operations. Rather, the test voltage provides an electrical stimulus to the TRIAC dimmer control 202, applied to at least one of terminal 204*a* and terminal 204*b*. In some embodiments, the electrical stimulus is applied between terminal 204*a* and terminal 204*b*.

In more detail, the TRIAC dimmer adapter 210 includes an internal power supply and/or power converter 212 that converts AC line power to a suitable DC test voltage. (It is understood that in some embodiments, the TRIAC dimmer adapter 210 receives power from another source, such as a power supply, a battery, or any suitable source of DC voltage.) In at least some embodiments, the adapter 210 also includes a detector 214, a processor 216 and a communications interface 218. In the illustrative embodiments, the detector 214 is coupled to the LOAD terminal 204*b*. The detector 214 is configured to measure an electrical response at one or more of the first and second externally accessible terminals 204*a*, 204*b* of the dimmer device 202. The measured electrical response is responsive to the applied test voltage and a setting of the user-adjustable control 206. The processor 216 is in electrical communication with the detector 214, such that the processor 216 receives an indication of the measured electrical response. The processor 216 is configured to determine from the measured electrical response an indication of the setting of the user-adjustable control 206. The processor 216 is further in communication with the communications interface 218, which is configured to convey an indication of the dimmer setting to the adjustable power supply 220. The adjustable power supply 220, in turn, adjusts an intensity of illumination provided by the LED lighting source 222 by an amount corresponding to the user adjustable setting 206.

In at least some embodiments, the TRIAC dimmer adapter 210 is also accommodated within a housing 211 that conforms to a typical single or multi-gang electrical switch box. Accordingly, in at least some embodiments, such a TRIAC dimmer adapter 210 can be installed together with a TRIAC dimmer control 202, within a common multi-gang standard electrical box 230. In at least some embodiments, the box 230 can be fed by an AC power feed or circuit, which can be split within the box 230 (e.g., using wire connectors 232*a*, 232*b*) to power the TRIAC dimmer adapter 210 and to a second set of electrical conductors 234 providing AC facility power to the adjustable power supply 220. The communications interface 218 can be configured to convey an indication of the dimmer setting to the adjustable power supply 220 by any suitable means. Examples include one or more dedicated lines (e.g., electrical conductors, optical fibers) 236 (shown in phantom), wirelessly and over available electrical conductors, such as the AC conductors 234, by using a suitable power line communications (PLC) protocol.

Figure 4:
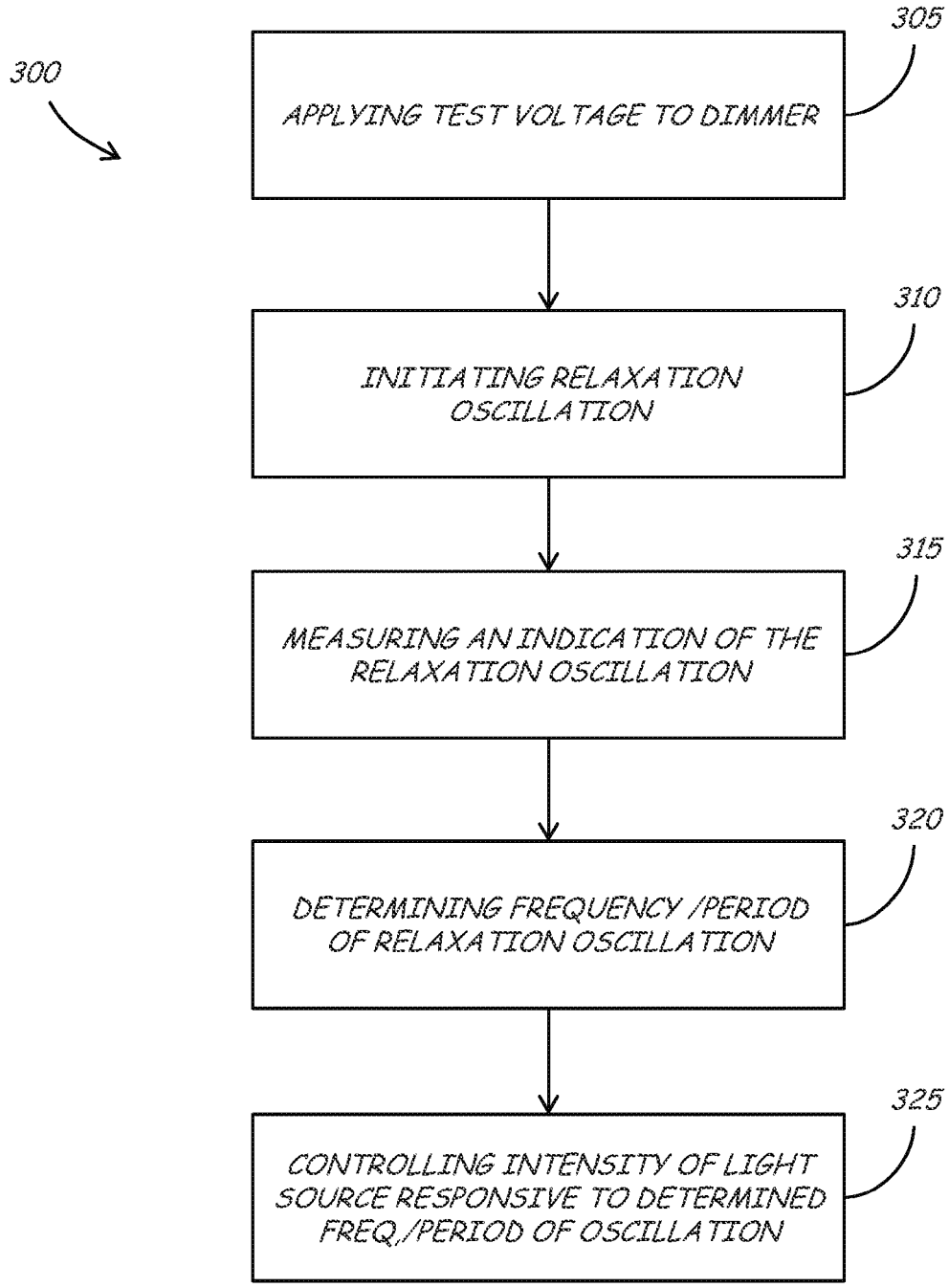
FIG. 4 is a flow diagram of an embodiment of a process for determining a setting of a dimmer control and dimming a light source responsive to the determined setting.

FIG. 4 is a flow diagram of an embodiment of a process 300 for determining a setting of a TRIAC dimmer control and dimming a light source in response to the determined control setting. In particular, a typical TRIAC dimmer control can be used as a human interface for adjusting intensity of an LED lighting source. In a significant departure from a typical installation, however, the TRIAC dimmer is not directly connected to facility AC power. Rather, an electrical stimulus, such as a relatively low DC voltage, is applied at 305 to one or more of first and second externally accessible terminals of the dimmer control. In response to a DC voltage sufficiently above the DIAC breakover voltage, a relaxation oscillation mode of operation is induced within the TRIAC dimmer at 310. The process includes measuring at one or more of the first and second externally accessible terminals, an electrical response of the dimmer control at 315. The measured response is indicative of the relaxation oscillation response. At least one of the frequency and period of the measured response is determined at 320. The intensity of a light source is selectively controlled in response to the determined frequency or period of relaxation oscillation at 325. Any such value indicative of the determined setting can be used to dim a light source.

In at least some embodiments, the output voltage representing a detected output can be converted, for example, to a digital value for interpretation by the processor 216. For example, the processor 216 can translate the detected output voltage to a control value according to a function, such as a predetermined lookup table. Alternatively or in addition, the output voltage can be used to directly drive the communications interface 218 for controlling the adjustable power supply 220 of the dimmable illumination source 222.

Figure 5:
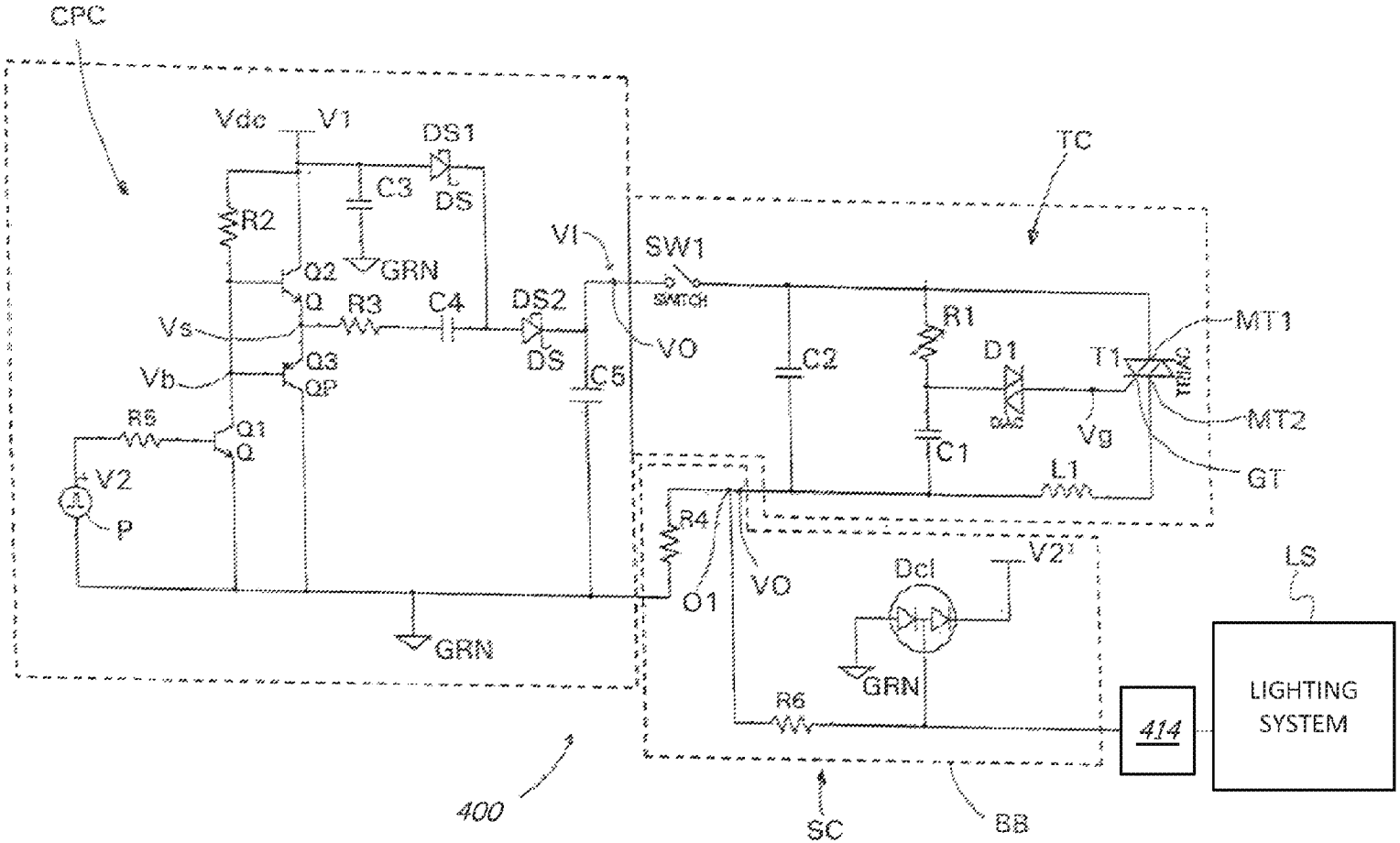
FIG. 5 is a circuit diagram of an embodiment of a system for determining a setting of a dimmer control and dimming a light source responsive to the determined setting.

According to a further aspect of the present invention, it will be noted that DIAC breakover voltage typically may exceed 35-volts DC, and such voltage may not be available in certain, if not most, solid state lighting applications. Therefore, a present embodiment of the invention thereby further includes a "charge pump" voltage multiplier CPC which, for example, multiplies the input voltage Vdc by two before supplying the input voltage V1 to TRIAC circuit TC at input VI. An embodiment of such a system including a charge pump is illustrated in FIG. 5.

The CPC circuit is controlled by a pulse input signal voltage V2 generated by a pulse source P which may comprise, for example, a microprocessor or some other circuit or source capable of generating the required waveform at the desired voltage levels and at a sufficiently high enough frequency so as to maintain CPC an output capacitor C5 charged at the desired voltage, which is higher than the DIAC breakover voltage of the DIAC D1 under the load of the TRIAC circuit TC and a sensing circuit SC, which will be described below. In order to maintain the charge of the capacitor C5, it is preferable that the frequency of the signal voltage V2 be within the range of 1 Hz to 1 MHZ and more preferably within the range of 40 Hz to 4 KHz.

As will be well understood by those of skill in the relevant arts, in the CPC circuit, a transistor Q1 switches a base input voltage Vb, which is provided from input voltage Vdc through a resistor R2, to drive a push-pull amplifier circuit comprising transistors Q2 and Q3, the output of which provides an output voltage Vs waveform, which switches between approximately Vdc and ground (GRN) which, in turn, charges CPC output capacitor C5 through the circuit comprising an inrush current limiting resistor R3 and a capacitor C4.

Starting from an initial starting state, at which point pulse input signal voltage V2 is 0 volts, Schottky diodes DS1 and DS2 allow current to charge the capacitor C5 to the voltage Vdc minus 2 forward diode drops. In this state, however, the transistor Q2 is conducting and allows the other side of the capacitor C4 to charge to near the same potential so there is a minimal voltage drop across the capacitor C4. When the pulse input signal voltage V2 is switched to its maximum level, the transistor Q1 pulls the Vb input of the push-pull amplifier circuit to near zero volts, that is, to near ground (GRN), and the output voltage Vs drops to approximately 0 volts as well. The Schottky diode DS1 provides current to the capacitor C4 to charge the capacitor C4 to near voltage Vdc while the transistor Q3 drives the output voltage Vs to ground (GRN), thereby sinking current through transistor Q3 to ground (GRN).

The next time the pulse input signal voltage V2 goes high, the lower potential side of the capacitor C4 is switched up to voltage Vdc by the transistor Q2 and the voltage, with reference to ground (GRN) at the higher potential side of the capacitor C4, is thereby doubled since the previous magnitude of the voltage V1 is now referenced to the voltage V1, and the capacitor C5 is charged through the Schottky diode DS2 to that level minus the Schottky diode drop. The Schottky diode DS2 does not allow current to be sunk back to ground (GRN) when the transistor Q3 is conducting. As a result of the operation of CPC circuit therefore, and after enough switching cycles have occurred to allow convergence, the capacitor C5 maintains the input voltage V1 to the TRIAC circuit TC at input VI that is twice the voltage of Vdc.

Lastly referring to the sensing circuit SC, since the CPC circuit is providing the input voltage V1 to the TRIAC circuit TC at the input VI which is sufficient to meet or exceed the breakover voltage of the DIAC D1 and thereby to allow current to conduct through the TRIAC T1, almost all of the voltage at the input VI of the TRIAC circuit TC must appear across the load resistor R4 and, in parallel, across the combination of a resistor R6 and a clamping diode pair Dc1, which provides a sensing voltage output V2' to be provided to pulse source P for control of the frequency of V2.

The current flowing to the load resistor R4 and the parallel combination of the resistor R6 and the clamping diode pair Dc1 must not exceed the holding current of the TRIAC T1, or the TRIAC circuit TC will not oscillate. Given a theoretical input voltage to the TRIAC circuit TC from the CPC circuit charge of 48 volts, for example, and a theoretical forward voltage of 0.7 volts for the TRIAC T1, 47.3 volts must be dropped across the resistor R4. It should be understood that the theoretical input voltage can range from 40 to 120 volts or more preferably the theoretical input voltage can range from 45 to 50 volts. Also, the theoretical forward voltage of the TRIAC can range from 0.2 to 1.0 volts or more preferably the theoretical forward voltage of TRIAC can range from 0.3 to 0.4, volts. The resistor R6 serves as a current limiting resistor for the clamping diode pair Dc1 and the high-side diode clamps the output signal to the V2' to ensure low enough voltage level to be sensed by a pulse source P, such as a microcontroller, without causing damage thereto.

It is to be appreciated that sensing the position of the potentiometer R1 is accomplished by sensing the frequency of oscillation in the TRIAC dimmer circuit. Input capture modules or interrupt driven timer counting can be used to determine frequency and, therefore, the potentiometer position. This circuitry provides a low-power, low-voltage method of sampling the TRIAC dimmer's position and allowing the system to work with higher voltage power signals with which the TRIAC dimmers would not typically operate. Furthermore, this circuitry allows a digital system to use a TRIAC dimmer as a source of input for dimming solid state or traditional sources without the negative effects of the TRIAC dimmer in series with power for the lights.

The relaxation frequency and/or period can be sensed using a suitable detector 414, alone or in combination with a microcontroller (e.g., processor 316, FIG. 3). In measuring such intervals of time, the TRIAC adapter 211 (FIG. 3) can include a timing reference. In some embodiments, the timing reference can be provided by a digital timing circuit, such as a resettable counter driven by a reliable clock source. Alternatively or in addition, the timing reference can be received from an external timing source. Thus, the processor can measure a period of time between corresponding portions of the relaxation response waveform (e.g., peaks). In at least some embodiments, the detector 414 and processor 316 also cooperate to determine when the capacitor C1 is sufficiently charged. This can be accomplished, for example, by monitoring the voltage at LOAD terminal 204*b*.

Having determined the relaxation frequency and/or period, the position of the potentiometer R1 (and hence the user-adjustable setting 206) can be inferred. For example, the detected time can be determined by the processor 316, which converts the measured time interval to a dimmer control setting according to a function, such as a lookup table. The processor 316 can, in turn, forward a suitable indication of the user-adjustable control 206 to a dimmable light, for example, through a suitable communications link, such as a power line communications link.

In the above description and appended drawings, it is to be appreciated that only the terms "consisting of" and "consisting only of" are to be construed in the limitative sense while of all other terms are to be construed as being open-ended and given the broadest possible meaning.

Since certain changes may be made in the above described improved system for sensing the position of a ELV dimmer, without departing from the spirit and scope of the invention herein involved, it is intended that all of the subject matter of the above description or shown in the accompanying drawings shall be interpreted merely as examples illustrating the inventive concept herein and shall not be construed as limiting the invention. Additionally, although the illustrative examples describe varying intensity or otherwise dimming lighting sources, it is understood that the techniques described herein can be used to vary other lighting source attributes, such as color, scene, color temperature, and the like.

Since certain changes may be made in the above described high power light emitting diode (LED) lighting unit for indoor and outdoor lighting functions, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Further, the invention has been described with reference to particular preferred embodiments, but variations within the spirit and scope of the invention will occur to those skilled in the art. For example, although the various examples provided herein relate to dimming light sources, similar devices and techniques can be used for the control of any suitable electrical device, such as electric motors (e.g., fans) or as may be advantageous in other aspects of industrial process control. It is noted that the foregoing examples have been provided merely for the purpose of explanation and are in no way to be construed as limiting of the present invention.

While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

We claim:

1. A method for dimming a light, comprising:

applying a test voltage to a dimmer device, the dimmer device having a user-adjustable control input settable between low and high dimmer settings;

initiating within the dimmer device, a relaxation oscillation responsive to the applied test voltage;

determining at least one of a frequency and a period of the relaxation oscillation initiated within the dimmer device, wherein the relaxation oscillation is indicative of a setting of the user-adjustable control input; and dimming a light source responsive to the determined dimmer device setting.

2. The method of claim 1, wherein applying the test voltage comprises:

providing a first dc voltage below the threshold voltage;

boosting the dc voltage to a second dc voltage not less than the threshold voltage; and applying a test voltage to a dimmer device.

3. The method of claim 1, wherein determining at least one of a frequency and a period of the relaxation oscillation comprises:

sampling for at least one cycle, at least one of a voltage and a current responsive to the relaxation oscillation; and determining at least one of a frequency and a period of the sampled at least one cycle.

4. The method of claim 1, wherein determining at least one of a frequency and a period of the relaxation oscillation comprises re-setting during an equi-phase portion of each cycle of the relaxation oscillation, a running counter, count values obtained by the running counter between re-sets indicative of the at least one of a frequency and a period of the relaxation oscillation.

5. The method of claim 1, wherein the dimmer device comprises a TRIAC.

6. The method of claim 5, wherein determining at least one of a frequency and a period of the relaxation oscillation comprises:

sampling for at least one cycle, at least one of a voltage and a current responsive to the relaxation oscillation; and determining at least one of a frequency and a period of the sampled at least one cycle.

7. A method for determining a setting value of a user-adjustable TRIAC dimmer, comprising:

applying a test voltage to a dimmer device, the TRIAC dimmer having a user-adjustable control input settable between low and high dimmer settings;

initiating within the TRIAC dimmer, a relaxation oscillation responsive to the applied test voltage; and determining at least one of a frequency and a period of the relaxation oscillation initiated within the TRIAC dimmer, wherein the relaxation oscillation is indicative of a setting of the user-adjustable control input.

8. The method of claim 7, wherein applying the test voltage comprises applying a dc voltage above a threshold voltage.

9. The method of claim 8, wherein applying the test voltage comprises:

applying a first dc voltage below the threshold voltage; and generating the test voltage by boosting the dc voltage to a second dc voltage not less than the threshold voltage.

10. A system for dimming a light, comprising:

a power supply in electrical communication with a dimmer device having a user-adjustable control input settable between low and high dimmer settings, the power supply configured to provide an electrical input not less than a threshold value sufficient to induce a relaxation oscillation within the dimmer device, the relaxation oscillation indicative of a setting of the user-adjustable control input; and a frequency detector in electrical communication with the dimmer device, the frequency detector configured to detect at least one of a frequency and a period of the relaxation oscillation.

11. The system of claim 10, wherein the power supply comprises a dc power supply, wherein the electrical input comprises a dc voltage.

12. The system of claim 11, further comprising a charge pumping circuit configured to increase the electrical input to a value not less than the threshold value, for dc voltages less than the threshold value.

13. The system of claim 10, further comprising an adjustable power source in communication with the frequency detector, the adjustable power source configured to provide an adjustable power to a lighting source corresponding to a setting of the user-adjustable control input.

14. The system of claim 13, wherein the adjustable power source comprises an adjustable dc power supply.

15. The system of claim 13, wherein the lighting source comprises a solid-state lighting source.

16. The system of claim 15, wherein the solid-state lighting source comprises at least one light emitting diode (LED).

17. The system of claim 10, wherein a frequency detector comprises a counter.

18. The system of claim 10, further comprising an analog-to-digital converter in electrical communication between the frequency detector and the dimmer device.

19. A system for detecting a setting of a line voltage dimmable controller, comprising:

means for applying a test voltage to a dimmer device, the TRIAC dimmer having a user-adjustable control input settable between low and high dimmer settings;

means for initiating within the TRIAC dimmer, a relaxation oscillation responsive to the applied test voltage; and means for determining at least one of a frequency and a period of the relaxation oscillation initiated within the TRIAC dimmer, wherein the relaxation oscillation is indicative of a setting of the user-adjustable control input.

* * * * *